United States Patent [19]

Hart

[11] Patent Number: 4,867,242

[45] Date of Patent: Sep. 19, 1989

[54] METHOD AND APPARATUS FOR BREAKING GAS LOCK IN OIL WELL PUMPS

[75] Inventor: Gordon E. Hart, Alberta, Canada

[73] Assignee: Amerada Minerals Corporation of Canada, Ltd., Calgary, Canada

[21] Appl. No.: 137,559

[22] Filed: Dec. 22, 1987

Related U.S. Application Data

[63] Continuation-in-part of Ser. No. 869,120, May 30, 1986, abandoned.

[30] Foreign Application Priority Data

May 31, 1985 [CA] Canada ..... 482881

[51] Int. Cl.[4] ..... E21B 43/00; F04B 19/22; F04B 21/04; F04B 39/10

[52] U.S. Cl. ..... 166/369; 166/105; 417/443; 417/444; 417/554

[58] Field of Search ..... 166/369, 68, 105; 417/511, 520, 554, 552, 443, 444, 459, 456, 435

[56] References Cited

U.S. PATENT DOCUMENTS

| | | | |
|---|---|---|---|
| 880,019 | 2/1908 | Futhey | 417/554 |
| 1,027,665 | 5/1912 | Parker . | |
| 1,184,018 | 5/1916 | Rathbun | 417/554 |
| 1,196,584 | 8/1916 | Randolph | 417/444 |
| 1,284,641 | 11/1918 | Francis . | |
| 1,529,104 | 3/1925 | Zinn . | |
| 1,555,230 | 1/1925 | Penrod et al. | 417/444 |
| 1,676,186 | 7/1928 | Hawkins | 417/444 |
| 2,214,956 | 9/1940 | Dunlap . | |
| 2,475,739 | 7/1949 | Frank . | |
| 2,528,833 | 11/1950 | Kelley . | |
| 2,690,134 | 9/1954 | Ritchey | 417/443 |
| 3,139,039 | 6/1964 | Adams . | |
| 3,215,085 | 11/1965 | Goostree | 417/444 |
| 4,338,066 | 7/1982 | Luker | 417/259 |
| 4,504,199 | 3/1985 | Spears | 417/456 |
| 4,557,668 | 12/1985 | Jones | 417/259 |
| 4,599,054 | 7/1986 | Spears | 417/456 |
| 4,673,338 | 6/1987 | Jones | 417/554 |
| 4,691,735 | 9/1987 | Horton | 137/494 |

*Primary Examiner*—Bruce M. Kisliuk
*Attorney, Agent, or Firm*—James R. Young

[57] ABSTRACT

A gas lock breaker for oil well pumps includes a stationary barrel with a standing valve on the bottom, a reciprocating piston in the barrel with a traveling valve on the bottom of the piston, an unseating rod positioned above the standing valve and adapted to protrude into the traveling valve to unseat the ball closure thereof near the bottom extremity of the downstroke of the piston. For a conventional well of any normal depth equipped with a pump jack for piston displacement anywhere in the range of 1 to 5 meters (3.3 to 16.4 feet), the unseating rod protrudes through the traveling valve a distance of about 1 to 15 percent of the piston stroke, or about 5 to 13 cm. (2 to 5 in.). The standing valve cage is preferably 12 to 20 cm. (4.75 to 8.0 in.), and the traveling valve is set to approach within 15 to 30 cm. (6 to 12 in.) of the standing valve. The initial space in the barrel between the traveling and standing valves at the maximum extremity of the piston upstroke is compressed on the downstroke to about 1 to 15 percent of the initial space when the rod unseats the ball closure. An initial space to space at unseating position compression ratio in the range of 10:1 to 12:1 is preferred, and the ball closure is opened by the rod during about 2 to 4 percent of the stroke travel.

11 Claims, 2 Drawing Sheets

METHOD AND APPARATUS FOR BREAKING GAS LOCK IN OIL WELL PUMPS

CROSS-REFERENCE TO RELATED APPLICATION

This patent application is a continuation-in-part of the pending U.S. patent application, Ser. No. 06/869,020, filed May 30, 1986 now abandoned.

BACKGROUND OF THE INVENTION

1. Field of the Invention

This invention relates generally to well pump equipment and more particularly to an apparatus for preventing gas locks in traveling piston-type well pumps.

2. Description of Related Art

When there is insufficient reservoir pressure in an oil well to overcome the hydrostatic head of the fluid in the well pipe, the oil and other fluids in the well cannot flow unaided to the surface for collection. In such wells, the fluid must be mechanically assisted or pumped to the surface. A variety of pumps, gas lift apparatus, and other devices exist for this purpose, but among the oldest, and yet most common and popular apparatus used are the stroking or traveling piston-type well pumps. These pumps typically have a standing one-way check valve positioned on the bottom of a string of tubing pipe in the liquid fluid near the bottom of the well, a traveling piston in a hollow cylindrical barrel just over the standing valve with a traveling one-way check valve in the piston, a sucker rod or pump rod extending from the piston to the well head on the surface of the ground, and a pump jack actuator or driver on the ground surface connected to the sucker rod for reciprocating the piston and traveling valve up and down in the well. The most common pump jack actuators or drivers are characterized by a pivoted rocking beam driven by a rotating crank shaft-type mechanism, although other actuators, such as hydraulic cylinder-driven pump jack apparatus, are also used.

These traveling piston-type pumps operate by drawing the piston upwardly, which results in drawing or sucking the fluid through the standing valve into the barrel. Then, the stroke is reversed so that the piston travels downwardly. During the downstroke, the standing valve closes to prevent fluid in the cylinder barrel from being pushed by the piston back into the well casing or back into the reservoir formation. At the same time, the traveling valve opens to allow the fluid above the standing valve to flow through the piston to a position in the cylinder barrel above the piston.

On the next upstroke, as the standing valve is opened to draw more fluid into the cylinder barrel under the piston, the traveling valve in the piston is closed to prevent the fluid above the piston from flowing back through the piston. In this manner, each successive stroke cycle of the piston draws more fluid from the formation to a position above the piston so that the fluid is pumped to the surface of the well where it can be collected for processing or sale.

Some of the reasons that the traveling piston-type pump has remained popular and effective over the years are that the mechanism is simple and the pump is usually reliable and easy to use. However, there are situations in which this kind of pump is not efficient or effective. For example, wells in reservoirs that produce excessive compressible fluids, such as natural gas, along with the noncompressible liquids, such as oil and water, tend to cause problems for this kind of pump.

The gas is easily drawn through the standing valve into the cylinder barrel on the piston upstroke. However, on the downstroke, when the standing valve is closed and the noncompressible liquid is normally expected to force the traveling valve open, gas between the traveling valve and the standing valve will compress, thereby allowing the hydrostatic head of the fluid above the traveling valve to keep the traveling valve from opening. Yet, on the upstroke, the gas and liquid above the standing valve prevent any more fluid from being drawn into the cylinder barrel, since the compressed gas merely expands to fill the expanding space between the standing and traveling valves. Consequently, the upstrokes and downstrokes of the pump cycles simply continue to alternately compress and expand the gas caught between the standing valve and the traveling valve without pumping any liquid. This condition is known as "gas lock" and prevents the pump from performing its intended function, i.e., pumping fluid in the well to the surface.

If there are sufficient quantities and pressure of gas in the reservoir, other apparatus are available for lifting fluids to the surface, such as gas lift, gas-driven pig devices, and the like. However, where there is enough gas in the well to gas-lock a traveling piston-type pump, yet not enough gas or pressure to drive other gas-powered lift mechanisms, a continuing problem has existed in recovering fluids from wells.

There have been other attempts to solve such gas-lock problems in traveling piston-type pumps. For example, the device in the U.S. Pat. No. 3,139,039, issued to E. Adams in 1964, was specifically intended to solve the problem of gas locks in a traveling piston oil well pumps. Adams coupled the traveling valve closure ball by an elongated rod to a secondary piston that frictionally engages the sides of the barrel to open the traveling valve. Sizing and placement of the components, however, still allows gas compression and decompression during the downstroke and upstroke. The Adams patent disclosure seems to identify the failure to pump oil in gassy fields as one of gas pressure in the tubing over the traveling valve, which is a different theory of the source of the problem than the explanation of the gas lock problem as I have described, and it attempts to solve the problem in a different way. Moreover, the frictional drag between the piston and the working barrel increases the load on the sucker rod, the motor, and the associated pump jack drive mechanism, gear box, and the like. Furthermore, over a period of time as the device is used, wear on the secondary piston changes its frictional drag causing unseating force on the valve closure to decrease and adversely affecting the pump jack counterbalance adjustments, thereby rendering the pump's operation uncertain and unreliable. Also, the apparatus disclosed by Adams does not permit free rotation of a ball valve closure on all axes, so it tends to wear faster and unevenly The U.S. Pat. No. 2,214,956, issued to W. Dunlap in 1940 uses a rod attached at the top end to the traveling valve closure member, while the bottom end of the rod frictionally slides through the standing valve closure member to urge the standing valve open and closed. Dunlap's attempted solution focused on what was apparently thought to be excessive gas pressure under the standing valve instead of between the standing valve and the traveling valve.

The U.S. Pat. No. 2,528,833, issued to K. Kelley in 1950 is also directed to an attempt to minimize the gas lock problem by reducing the space between the standing valve and the traveling valve. U.S. Pat. Nos. 1,184,018 granted to Rathbun in 1916, and the 3,215,085, issued to Goostree in 1965 both employ operating mechanisms somewhat similar to that of the current invention. These early inventions advanced the state of the art at that time. However, experience has shown that in order to achieve dependable, efficient gas lock breaking or prevention, additional improvements still were necessary. Even where gas lock breakage is partially effective, it is often necessary to operate pumps at speeds faster or slower than the natural flow rate of fluid from the reservoir. Such circumstances usually result in substantially decreased production from the well, and, in many instances, production is not even economically feasible at all.

Consequently, prior to this invention, there still remained a need to improve on the various previous attempts to solve the gas lock problem. With the current invention under test in approximately 1000 gassy wells, production from these wells has on the average doubled. The reason for the increased production is because the present invention is more highly effective and efficient at breaking and effectively eliminating gas locks, and, as a result, it permits pumping at optimum speed for fluid production from the reservoir of any given well, rather than at the inefficient speeds necessary in other designs to break gas locks.

SUMMARY OF THE INVENTION

Accordingly, it is a general object of this invention to provide a new and improved method and apparatus for breaking gas locks in traveling piston-type oil well pumps.

It is a more specific object of this invention to provide a method and apparatus for breaking gas locks by positively unseating the traveling valve closure during pumping operations in a highly effective and nearly fail-safe manner that does effectively break or prevent gas locks and that does not cause damage or excessive mechanical wear to pump components.

It is also a specific object of this invention to traveling valve closure during pumping operations, wherein the maximum unseating force that can be applied to the closure is not dependent on a level of frictional drag produced by the device.

It is a further object of this invention to provide a gas lock breaking device which does not require additional frictional drag for producing the valve closure unseating force.

It is a still further object of this invention to provide a device in which the maximum force that can be applied to unseat the valve closure will not vary with use.

It is also a specific object of this invention to provide a method and apparatus for pumping gassy wells by first compressing the gases in the space between the standing valve and the traveling valve and then positively opening the traveling valve to allow the compressed gas to escape said space through the traveling valve.

It is yet a further specific object of this invention to compress the gas by a ratio such that when the traveling valve is positively opened, the escaping compressible gas is partially replaced by an amount of the standing column of noncompressible fluid above the traveling valve, further displacing the gas trapped between the standing valve and the traveling valve, so that said amount of noncompressible fluid acts to "reprime" the pumping apparatus and reestablish positive upward displacement of said noncompressible fluid.

A more specific object of the present invention is to provide an apparatus that positively opens said traveling valve in a manner that ensures adequate displacement of said compressed gas from said space between the traveling valve and the standing valve by displacing the closure mechanism of said traveling valve sufficiently to allow adequate time for escape of said compressed gas and at least partial replacement of said compressed gas by said noncompressible fluid.

Another specific object of the invention is to provide more effective sizing, dimensions, and ratios for gas breaker apparatus components to achieve more effective, consistent, and optimum gas lock elimination or breaking for maximum fluid production from gassy wells.

Another specific object of the present invention is to provide an apparatus that will break gas locks while operating constantly at the optimum speed of pumping for a given well, rather than requiring variations of pumping speed to inefficient rates in order to break gas lock.

Additional objects, advantages, and novel features of this invention are set forth in part in the description that follows, and in part will become apparent to those skilled in the art upon examination of the following specification or may be learned by the practice of the invention. The objects and advantages of the invention may be realized and obtained by means of the instrumentalities and in combinations particularly pointed out in the appended claims.

To achieve the foregoing and other objects and in accordance with the purposes of the present invention, as embodied and broadly described herein, the apparatus of this invention may comprise, an improvement in an oil well pump that has a piston adapted to be reciprocated by a pull rod attached thereto in a barrel wherein the improvement includes a valve closure unseating rod attached to the standing valve so that said rod is immovable and projects upwardly from the standing valve, a traveling valve that has a valve seat with a passage therein attached to the piston, and a spherical valve closure member captured in an elongated valve cage. The stroke of the piston is set so that the unseating rod penetrates the traveling valve only during about 5–13 cm (3–5 in.) of the stroke at the bottom portion of the stroke, but maintains the traveling valve in an open condition for a time sufficient for escape of gas and reestablishment of noncompressible fluid displacement. To further achieve the foregoing and other objects and in accordance with the purposes of the present invention, the method of this invention may comprise the steps of positioning an elongated, rigid rod immovably above the standing valve, and setting the stroke of the pump so that the traveling valve moves downwardly a sufficient distance at the bottom portion of each stroke to cause the rigid rod to protrude through the traveling valve seat to displace and unseat the traveling valve closure member. The method, therefore, includes the steps of compressing the gas between the standing valve and the traveling valve by moving the traveling valve downwardly in the barrel with both the traveling valve and the standing valve closed, and then, in the last 5–13 cm (2–5 in.) of the downstroke, positively opening the traveling valve and allowing the compressed gas to escape through the traveling valve, and permitting at least partial replacement of said compressed gas by noncompressible fluid, thus reestablishing positive noncompressible fluid flow.

DESCRIPTION OF DRAWINGS

The accompanying drawings, which are incorporated in, and form a part of, the specifications illustrate the preferred embodiment of the invention, and, together with the description, serve to explain the principles of the invention. In the drawings.

DETAILED DESCRIPTION OF THE PREFERRED EMBODIMENT

Figure 1:
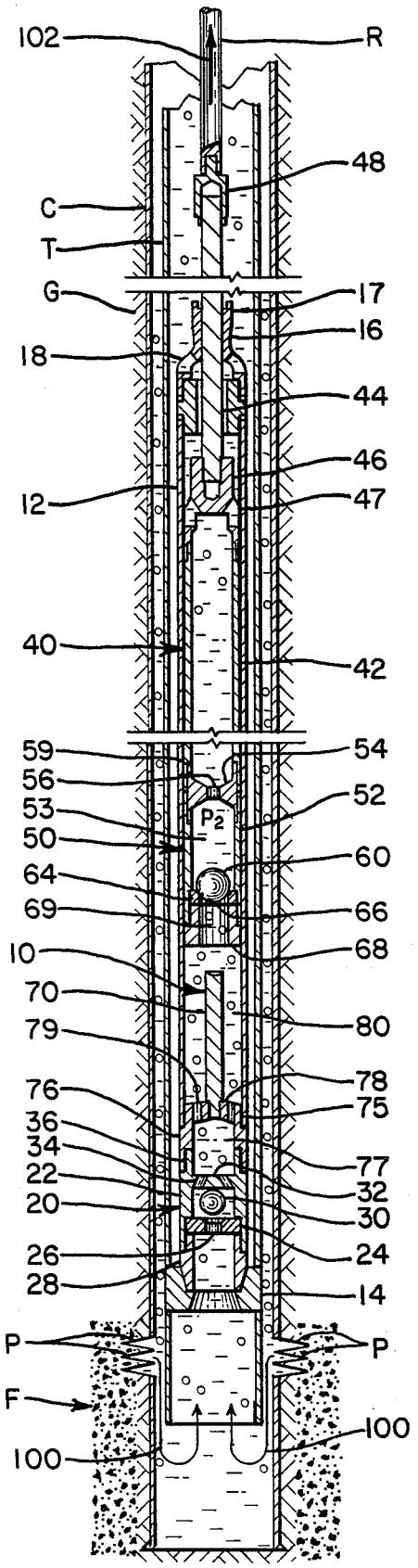
FIG. 1 is an illustration in cross section of a pump incorporating the gas lock breaker apparatus of the present invention positioned in a well showing the components in the upstroke mode.
Figure 2:
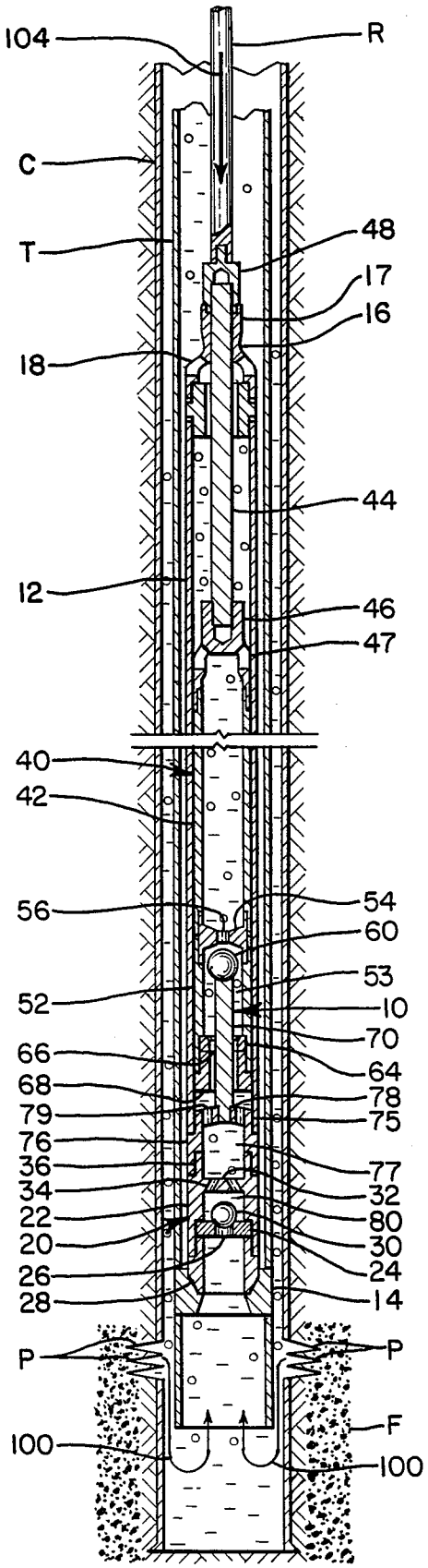
FIG. 2 is an illustration in cross-section of the apparatus of FIG. 1 with the traveling valve in its most downwardly position at the end of a downstroke.

The gas lock breaker apparatus 10 according to the present invention is illustrated in FIGS. 1 and 2 as an integral component of an otherwise conventional oil well pump of the type that has a standing valve assembly 20 at the bottom and a reciprocating piston assembly 40 with a traveling valve assembly 50 therein. The pump assembly is illustrated in FIG. 1 with the piston assembly 40 being pulled in the upstroke mode, as indicated by the arrow 102. The pump is illustrated in FIG. 2 with the piston assembly 40 illustrated near the end of its downstroke mode, as indicated by the arrow 104.

The structure of the typical oil well pump apparatus, although generally conventional in the art, is described herein in some detail in order to facilitate a description and understanding of the structure, functions, and advantages of the gas lock breaker 10 of the present invention. A typical oil well has a casing C positioned in a well bore and substantially sealed in position by a cementitious material or grout G. The casing C is perforated by directional explosive charges to form holes or perforations P that penetrate through the casing C and into the reservoir formation F. A tubing string T is positioned inside the casing C for producing or conducting the crude oil and other fluids from the bottom of the well to the surface where it can be collected for further processing and use.

The reciprocating pump assembly is positioned in the well fluid at the bottom of the tubing T, and is adapted to pump the well fluids to the surface. As generally shown in FIG. 1, the standing valve assembly 20 is positioned adjacent the bottom end of the tubing T. The piston assembly 40, with a traveling valve assembly 50 at the bottom end thereof, is slideably positioned inside a cylindrical pump barrel 12, where it is reciprocated upwardly and downwardly by a sucker rod R attached to an actuator or pump jack (not shown) on the ground surface adjacent the well.

The standing valve assembly 20 is generally comprised of a hollow cylindrical cage housing 22 with a spherical closure element or ball stopper 30 positioned inside the cage housing 22. A valve seat 24 with a longitudinally axial passage 26 therethrough is positioned at the bottom of the cage housing 22 under the ball closure 30, and is held in place by a retainer bushing 28. The retainer bushing 28 is seated in a packer collar 14 that is integrally connected to the tubing T. The top of the cage housing 22 is defined by a transverse end wall 32 having a plurality of passages 34 extending therethrough. The axial length of the cage housing 22 is sufficient to allow the ball closure 30 to move vertically upwardly and downwardly above the valve seat 24.

The cylindrical pump barrel 12 extends upwardly from the standing valve assembly 20 inside the tubing T to a bonnet 16 at the top having a plurality of fluid passages 18 extending therethrough. The piston assembly 40 is slideably positioned inside the cylindrical pump barrel 12 and is adapted for reciprocal movement upwardly and downwardly inside the barrel 12. The piston assembly 40 is comprised essentially of a hollow cylindrical plunger 42 having a top closure section 46 on its upper end and a traveling valve assembly 50 at its bottom end. A pull rod 44 is connected by threaded attachment to the piston top 46 and extends upwardly through the barrel bonnet 16. The top end of the pull rod 44 is connected to the bottom of the sucker rod R by a threaded collar 48. The top 46 of the piston has a plurality of passages 47 extending therethrough.

The traveling valve assembly 50 is connected by threaded attachment to the bottom of the cylindrical plunger 42 and is comprised of a hollow cylindrical cage housing 52 with a closure element or ball 60 captured therein. A valve seat element 64 with an axial bore or passage 66 extending longitudinally therethrough partially closes the bottom of the cylindrical cage housing 52. The valve seat 64 is secured in position by a retainer bushing 68 having an opening 69 extending longitudinally therethrough. The top of the cage housing 52 is partially closed by an end wall 54 with a plurality of passages 56 extending therethrough from the cage housing into the interior of the cylindrical plunger 42.

The conventional pump assembly in operation functions by the reciprocating upward and downward movement of the piston assembly 40 inside the pump barrel 12. Specifically, as the sucker rod R, through the linkage of the pull rod 44, pulls the piston assembly 40 upwardly within the stationary pump barrel 12, crude oil and other fluids are drawn from the reservoir formation F through the perforations P into the casing C and into the bottom of the tubing T, as indicated by the arrows 100. The fluid continues to flow upwardly through the axial bore or aperture 26 and the valve seat 24 and into the cage housing 22. As the fluid flows into the cage housing 22, the ball closure 30 is lifted away from the valve seat 24, but is held within the cage housing 22 by the end wall 32. However, while the ball closure 30 is retained within the cage housing 22, the fluid continues to flow upwardly through openings 34 into a space 80 between the standing valve assembly 20 and the traveling valve assembly 50.

On the downstroke, the ball closure 30 of the standing valve assembly 20 seats in the valve seat 24 and closes the aperture 26 therethrough, so that fluid previously drawn into the space 80 above the standing valve 20 cannot be pushed back into the casing C below the tubing T. Therefore, as the piston assembly 40 and traveling valve assembly 50 move downwardly through the stationary barrel 12, the ball closure 60 and the standing valve assembly 50 is forced by the liquid in space 80 upwardly away from the valve seat 64, so that the fluid in space 80 can flow through the aperture 66 in valve seat 64 into the cage chamber 53. From the cage chamber 53, the fluid continues to flow through passages 56 in end wall 54 and into the interior of the cylindrical plunger 42. From the plunger 42, the fluid continues to flow through passages 47 into the cylindrical barrel 12.

In a continuation of the conventional reciprocating pump cycle, after the downstroke, the sucker rod R again pulls the piston assembly 40 upwardly in the barrel 12. In this upstroke, the ball closure 60 seats in the valve seat 64, thereby closing the passage 66 therethrough. Consequently, as the piston assembly 40 moves upwardly, the fluid in the barrel 12 is forced or pumped through the passages 18 into the tubing T above the barrel 12. Simultaneously, as the piston assembly 40 moves upwardly, the ball closure 30 in the standing valve 20 opens again, thereby allowing the flow of fluid from the formation reservoir F into the space 80 between the standing valve 20 and the traveling valve 50. As this reciprocating cycle continues over and over again, the fluid in the well is eventually pumped to the surface.

The presence of gas in the reservoir fluid, however, can interfere with the upward flow of liquids through the pump in the manner described above. Specifically, the gases, like the liquid, flow through the standing valve assembly 20 and into the space 80 between the standing valve 20 and the traveling valve 50. During the upstroke of the pump, when the ball closure 60 in traveling valve 50 is closed, the gas in the space 80 under the traveling valve can expand to take up and occupy the expanding space 80 in the barrel 12. Therefore, little or no additional fluid from the reservoir formation F can be drawn through the standing valve assembly 20 and into the space 80.

It should be appreciated that the pressure on ball closure 60 tending to hold it against the valve seat 64 is tremendous as a result of the hydrostatic head of the fluid standing in the entire tubing string T of the well extending from the bottom of the well to the surface of the ground. In many practical applications, the height of this standing column of fluid in the tubing T can be as much as 6,000 to 10,000 feet or more. Therefore, as the piston assembly 12 travels downwardly during the downstroke, there is tremendous pressure above ball closure 60 to keep it seated against the valve seat 64. When there is expanded gas in the space 80 under the traveling valve assembly 50, the pressure $P_1$ in the space 80 can be less than the pressure $P_2$ in the ball cage housing 52 above the ball closure 60. In these circumstances, the ball closure 60 will not open, and the gas in space 80 cannot move upwardly into the piston assembly 40. As a result, the piston assembly 40 can continue to reciprocate upwardly and downwardly in the barrel 12, while the gas in space 80 merely expands on the upstroke and compresses on the downstroke under the traveling valve 50. With the gas in space 80 merely expanding and contracting during the pump cycles, no fluid can flow upwardly from the formation reservoir F to the tubing T above the barrel 12. This condition, as mentioned above, is known in the industry as gas lock, and it effectively prevents the pump from pumping fluid to the surface of the well, much in the fashion that vapor lock in a fuel line prevents fuel from reaching a carburetor.

Figure 3:
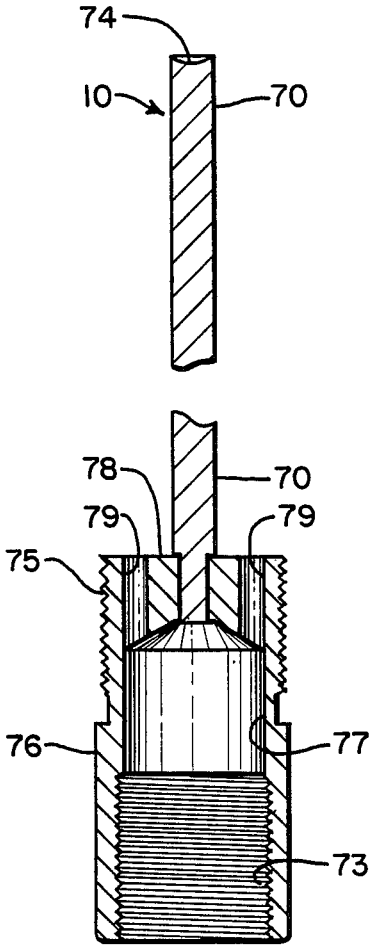
FIG. 3 is an illustration in cross-section of the gas lock breaker of the present invention.

The gas lock breaker 10 according to this invention is designed not only to force open the ball closure 60 in the traveling valve assembly 50, in spite of the presence of gas in the space 80 under the traveling valve assembly 50, but also to induce the gas in the space 80 to move upwardly through the traveling valve assembly 50 and into the cylindrical plunger 42 and to hold ball closure 60 off of traveling valve aperture 66, thus opening traveling valve assembly 50 for a sufficient time as to allow escape of compressed gas and at least partial replacement of said compressed gas by a portion of said fluid of said standing column, thereby reestablishing positive displacement (flow) of said fluid. Specifically, the gas lock breaker apparatus 10 is comprised essentially of two components. The first of those components, as illustrated in FIG. 3, includes a vertical elongated rod 70. The lower proximal end 72 of the rod 70 is rigidly fastened to the top of a cylindrical rod anchor attachment 76. The rod anchor attachment 76 has a lower internally threaded end 73 and an upper closed end 78, with an intermediate central chamber or passage 77 under the closed end 78. The plurality of smaller passages 79 extend through the end wall 78 from the central chamber 77. The top portion 75 of the rod anchor attachment 76 is externally threaded for connection to the bottom of barrel 12. The distal end 74 of the elongated rod 70 has a hollowed recess 74 therein.

Figure 4:
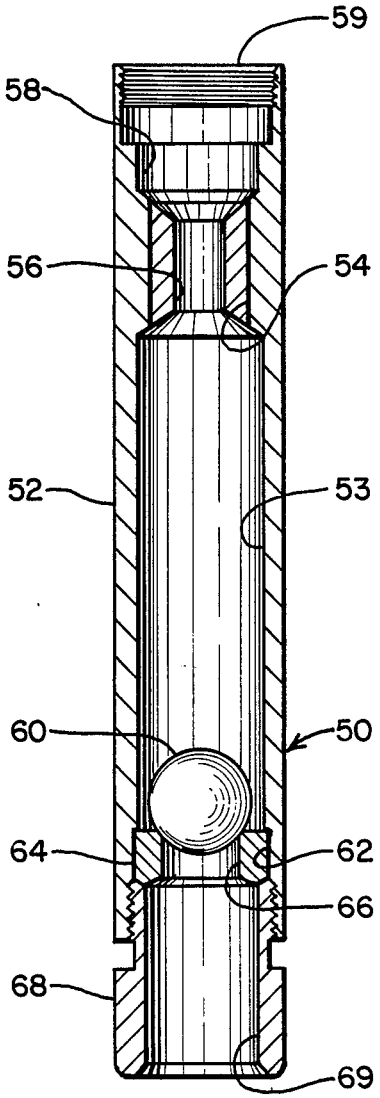
FIG. 4 is a cross-sectional view of the traveling valve assembly in accordance with the present invention.

The second component of the gas lock breaker apparatus 10 is the specifically designed traveling valve assembly 50, shown in FIG. 4, in which the longitudinal length of the cage chamber 53 in the cage housing 52 is sufficient to accommodate the ball closure 60 and the elongated rod 70 extending therein. The valve seat 64 has an axial bore or aperture 66 therethrough which is sufficiently large in diameter to enable the elongated unseating rod 70 to extend therethrough with sufficient annular space around the periphery of the rod 70 to accommodate the flow of well fluids and gases through the aperture 66 while the rod 70 is extended therethrough. The ball closure 60 is of a diameter less than the diameter of the cage chamber 53, so that the ball closure 60 is free to move along the longitudinal length of the cage chamber 53 and to rotate freely on all axes, while there is also sufficient space around the ball closure 60 to permit the flow of fluid around the ball 60 in the cage chamber 53.

Referring now again to FIGS. 1 and 2, in conjunction with FIGS. 3 and 4, attachment 76 is mounted on the externally threaded neck 36 of the standing valve 20 by means of internally threaded connection 73, with the unseating rod 70 directed upwardly coaxially with the barrel 12. As thus connected, the unseating rod 70 is rigidly attached to the top of the standing valve assembly 20 and is unyielding and immovable with respect thereto.

FIG. 1 illustrates the pump during the upstroke portion of its cycle. As briefly described above, during the upstroke portion of the pump cycle, the pressure $P_2$ above ball closure 60 in traveling valve 50 exceeds the pressure $P_1$ in the space 80 below the ball closure 60, thereby causing ball closure 60 to remain seated. As a result, the fluid above the closure 60 is moved upwardly along with the upward movement of the piston assembly 40. At the same time, the pressure $P_1$ above the ball closure 30 of the standing valve 20 is less than the pressure below it, thereby causing ball closure 30 to be unseated and permitting fluid to flow into the space 80 between the standing valve 20 and the upwardly moving traveling valve 50.

During the downstroke portion of the pump cycle the pressure $P_1$ in the space 80 above the standing valve 20 causes ball closure 30 to seat on valve seat 24, thereby preventing downward flow of fluid through passage 26.

During normal operation of the pump in non-gassy conditions, downward movement of the piston 40 during the downstroke portion of the pump cycle causes the pressure $P_1$ below the traveling valve closure 60 to exceed pressure $P_2$ above the valve closure 60, as described above for a conventional pump operation. Therefore, the incompressible liquid beneath the traveling valve closure in non-gassy conditions causes the traveling valve closure 60 to be unseated, allowing the liquid to flow via passage 69 into cage chamber 53, and hence through the passages 56 into the cylindrical plunger 42.

However, when the space 80 beneath the traveling valve 50 contains gas, the pressure $P_2$ above the traveling valve 50, due to the hydrostatic head of the fluid in the column of tubing T , will tend to maintain the valve closure 60 in the seated position during most of the downward travel stroke of the piston assembly 40. Thus, during most of the downstroke, the piston assembly 40 merely compresses the gas in the space 80 with the valve closure 60 seated, as described above for a conventional pump. However, as the traveling valve 50 approaches standing valve 20 near the bottom of the downstroke, the unseating rod 70 enters the aperture 66 in the valve seat 64 and thereafter enters the cage chamber 53. If the closure ball 60 is still seated by reason of compressed gas below the traveling valve 50, the unseating rod 70 contacts and forces the ball closure 60 off the seat 64 and pushes it upwardly into the cage chamber 53. As this unseating occurs, the compressed gas from space 80 surges through aperture 66 into the piston chamber 42 above the standing valve 50.

The recessed dished configuration at the distal end 74 of the unseating rod 70 has a concave rounded surface of the same radius as the radius of ball closure 60. Therefore, as rod 70 contacts the ball closure 60, the recess tends to distribute the contact surface between the rod 70 and the ball closure 60 over a relatively larger area than would otherwise be the case if the distal end 74 was not hollowed or recessed. Moreover, the recessed distal end 74 also tends to hold the ball closure 60, causing it to travel in a central path along the longitudinal axis of the cage chamber 53, thereby tending to reduce contact between the ball closure 60 and the walls of the cage housing 52. By this means, wear on the parts is reduced. Also, since the rod 70 only contacts the ball closure 60 near the bottom of the downstroke, the contact is made at a point where the downward velocity of the pump is greatly reduced due to the crank shaft position of the pump jack nearing its vertical direction change point. Therefore, momentum of the impact of the ball 60 on the rod 70 is relatively small.

As mentioned above, when the ball closure 60 is unseated near the bottom of the downstroke, the compressed gases causing the gas lock will surge upwardly through the aperture 66. By this means gas present below the valve closure 60 is allowed to escape up the well and a gas-lock formed by the presence of gas in the pump, is broken, even when there is no liquid in the space 80 to open the traveling valve closure 60. It has been found that the sudden, positive opening fully of the traveling valve 50 after initially compressing the gas in space 80 for most of the downstroke causes a surge of gas through the traveling valve hat would not occur either by unseating the ball closure 60 near the start of the downstroke or by not providing a sudden opening fully of the traveling valve 50 by the positive force of rod 70. By carefully choosing the length of rod 70 so as to displace traveling valve closure 60 sufficiently to allow not only escape of most of said gas from space 80, but also partial replacement of said gas by said noncompressible fluid, the fluid replaces gas in said space 80, once again reestablishing positive displacement (pumping) of said fluid. The result is a far more effective gas lock break than was available before this invention. The self-repriming feature of this invention does not require the speed of the pump's operation to be speeded up or slowed down in order to break the gas lock and restore pumping action, but allows the pump to continue to operate at the optimum rate for the given well, thus optimizing production for the well.

The ball closure 60 remains unseated at least throughout the portion of the cycle in which the distal end 74 of rod 70 is above the valve seat 64. This period can be adjusted by varying the point of maximum downward travel of the traveling valve 50. During the initial stroke setting procedure, the downward movement of the traveling valve 50 can continue until collar 48 contacts the shoulder 17 on bonnet 16. At that "tag point", the rod 70 has reached its maximum penetration of the cage chamber 53. The point of maximum penetration is determined by the length of the piston rod 44 from the collar 48, which may be adjusted to set the maximum length of the unseating rod 70 within the cage chamber 53 to slightly less than the length of the cage chamber 53 minus the diameter of the ball closure 60. By this means clearance is provided so that the unseating rod 70 does not force the ball closure 60 to impact against the top end 54 of the cage housing 52. Then, to prevent hammering of the collar 48 on the shoulder 17, the sucker rod R is pulled upwardly about 2 to 6 cm. (0.75 to 2.5 in.) and set as the lowest travel of the downstroke of the pump jack. Due to the length of the cage chamber 53 and the length of the rod 70 extending into the cage chamber 53, this upward adjustment to prevent hammering can be tolerated easily without adversely effecting either the normal operation or the gas lock breaking operation of the pump. In other words, the gas lock breaker 10 design of this invention allows sufficient tolerance in adjustment to be practical as well as effective.

It has been found that for pumps having working stroke lengths in a standard range of about 1 to 5 meters (3.3 to 16.4 feet) or more, satisfactory operation is obtained when the ball closure 60 is unseated over approximately 5 to 13 cm. (2 to 5 in.), preferably about 8.9 cm. (3.5 in.), of travel at the bottom of the downstroke. Unseating of the ball closure 60 for less than the specified amounts of the downstroke should theoretically be sufficient to release the compressed gas in space 80, but experience in over 200 gassy wells has shown that designs that unseat the ball closure 60 a distance less than the preferred range experience considerable difficulty in breaking the gas lock successfully. For this preferred working range of 5 to 13 cm. (2 to 5 in.), a suitable cage chamber 53 length is about 12 to 20 cm. (4.75 to 8.0 in.), so the ball closure 60 approaches to within about 2 to 7 cm. (1.0 to 2.75 inches) of the end wall 54, thereby leaving sufficient tolerance or space so that the ball closure 60 will not be hammered against the end wall 54 during operation, which could cause unacceptable wear and early breakdown. Suitable unseating rod 70 dimensions are about 13 to 21 cm. (5.25 to 8.25 in.) long, 17 cm. (6.75 inches) preferred, and about 1.5 cm. (0.6 in.) in diameter. A normal ball closure 60 is about 2 to 3 cm. (0.79 to 1.18 in.) in diameter, so the aperture 26 in the traveling valve seat 24 should have a diameter of about 1.75 to 2.50 cm. (0.70 to 1.0 in.), depending to some extent on the actual diameters of the unseating rod 70 and ball closure 60. The diameter of the aperture 26, of course, has to be large enough to allow the unseating rod 70 to protrude therethrough easily, with enough space to spare for the compressed gas in the space 80 between the standing valve ball 30 and the traveling valve ball 60 to escape through the aperture 26 when the rod 70 unseats the ball closure 60.

The space 80 between the ball closures 30, 60 at the bottom of the downstroke should be as small as practical, but the tolerance should not be so close that there is danger of the traveling valve assembly 50 actually hammering on the standing valve assembly 20 during operation of the pump. Therefore, in practice the distance between the end wall 78 and the bottom of bushing 68 is set at about 2.5, to 7.5 cm. (1.0 to 3 in.), usually about 4.5 cm. (1.75 in.). Since the bushing 68 and seat 64 are about 3 cm. (1.125 in.) combined, the chamber 77 is preferably about 6 cm. (2.4 in.) long and the cage 22 is about 5 cm. (2 in.) long, the distance between the ball closure 60 and the ball closure 30 is about 15 to 30 cm. (6 to 12 in.).

The result, therefore, is that the gas in the space 80 (assuming a gas lock situation in which space 80 is substantially full of gas and devoid of liquid) is compressed for virtually all of the 1 to 5 meters of a normal downstroke of the piston assembly 40, except for the last approximately 5 to 13 cm. (2 to 5 in.), i.e., about 1.5 to 13 percent, of the piston travel. Therefore, by the time the ball closure 60 is contacted and opened by rod 70, the gas is highly compressed, preferably to a volume in the range of about 1 to 15% of the volume of space 80 at the start of the downstroke. When the ball closure 60 finally opens, the compressed gas in space 80 will surge upwardly through the traveling valve assembly 50, thus breaking the gas lock condition.

The displacement of valve closure 60 by rod 70 by a distance in the range of about 5 to 13 cm. (2 to 5 in.) for pump strokes in the range of 1 to 5 m. (3.3 to 16.4 ft.) ensures that the valve closure 60 remains closed long enough to get sufficient compression and then displaced for a sufficient time as to allow the compressed gas to escape, and for some of the noncompressible fluid that is above the traveling valve 50 to enter space 80, effectively "repriming" said oil well pump apparatus and allowing effective pumping action to resume.

The above sizes and parameters, such as rod 70 length, penetration distance of rod 70 into cage 52, and distance between bushing 68 and anchor 76, as well as other parameters discussed above, can be adjusted to reach approximate mid-range of the compression ratio for a given stroke. For example, the use of a 9 cm. (3.5 in.) penetration into cage 52 by the distal end of a 17 cm. (6.75 in.) rod 77 for a standard 3 m. (9.8 ft.) stroke results in a compression ration in the range of 10:1 to 12:1 and a sufficient open period for ball 60 in the range of about 2 to 4 percent of the stroke travel, which I have found to work very well for this purpose. For longer strokes, longer rods, more penetration, and greater clearance settings between the bushing 68 and rod anchor 76 can be used to maintain parameters within these preferred compression ratio and open ball portion of stroke ranges. Likewise, smaller strokes may require adjustment of the parameters downwardly to stay within these preferred compression and open ball dwell time ranges. Of course, if there is sufficient noncompressible liquid in the space 80, the liquid will force the ball closure 60 off the valve seat 64 in the conventional manner before the rod 70 contacts the ball closure 60.

The foregoing description is considered as illustrative only of the principles of the invention. Further, since numerous modifications and changes will readily occur to those skilled in the art it is not desired to limit the invention to the exact construction and processes shown and described above. Accordingly, all suitable modifications and equivalence may be resorted to falling within the scope of the invention as defined by the claims which follow.

The embodiments of the invention in which an exclusive property or privilege is claimed are defined as follows:

1. In an oil well pump for pumping oil from a well wherein said pump has an elongated cylindrical barrel, the elongated axis of which defines a longitudinal axis of the barrel and of the pump, a reciprocating piston slideably positioned in the barrel for cyclic reciprocal movement up and down a preset distance in the range of about 1 to 5 meters (3.3 to 16.4 feet) in the barrel for pumping fluid to the surface of the well, a traveling check valve at the bottom of the piston, and a standing check valve at the bottom of the barrel, wherein the traveling check valve has a valve seat with an aperture therethrough that is aligned with the longitudinal axis of said cylindrical barrel and a moveable closure member above the valve seat, which closure member is adapted for seating in the valve seat for closing the aperture when pressure above the aperture is greater than pressure below the aperture and for moving upwardly from the valve seat to open the aperture when the pressure below the aperture is greater than pressure above the aperture, the improvement comprising:

a rigid elongated rod immovably mounted in the barrel above the standing valve and having a distal end extending upwardly toward said traveling valve in longitudinal alignment with said aperture, said rod having a diameter small enough to fit through said aperture and a sufficient length such that said distal end protrudes upwardly through said aperture a maximum distance in the range of about 1 to 13 percent of said preset distance in order to contact and displace said closure member from said valve seat as the traveling valve approaches the bottom of the downward stroke of each reciprocal cycle and wherein the initial volume between the traveling valve and the standing valve at the start of the downstroke is compressed to a range of about 1 to 15 percent of said initial volume before said distal end of the rod contacts and displaces said closure member in the traveling valve.

2. The improvement of claim 1, wherein the maximum displacement of said closure member of said traveling valve by said rigid elongated rod is in the range of at least about 5 cm. and not more than about 13 cm. (2 to 5 in.).

3. The improvement of claim 1, wherein said maximum protrusion distance of said rod through said aperture is in the range of at least about 2 percent and not more than about 4 percent of said preset distance.

4. The improvement of claim 1, wherein the compression ratio of said initial volume to the volume between the standing valve and the traveling valve at the point where the rod contacts and displaces the closure member of the traveling valve is in the range of 10:1 to 12:1

5. In an oil well pump for pumping oil from a well wherein said pump has an elongated cylindrical barrel, the elongated axis of which defines a longitudinal axis of the barrel and of the pump, a reciprocating piston slideably positioned in the barrel for cyclic reciprocal movement up and down a preset distance in the range of about 1 to 5 meters (3.3 to 16.4 feet) in the barrel for pumping fluid to the surface of the well, a traveling check valve at the bottom of the piston, and a standing check valve at the bottom of the barrel, wherein the traveling check valve has a seat with an aperture therethrough that is aligned with the longitudinal axis of said cylindrical barrel and a moveable closure member above the valve seat, which closure member is adapted for seating in the valve seat for closing the aperture when pressure above the aperture is greater than pressure below the aperture an for moving upwardly from the valve seat to open the aperture when pressure below the aperture is greater than pressure above the aperture, the method of breaking a gas lock between the traveling and standing valves comprising the steps of:

positioning a rigid elongated rod immovably in the barrel above the standing valve with its distal end extending upwardly toward said traveling valve in longitudinal alignment with said aperture;

moving the traveling valve from its uppermost position downwardly toward the standing valve a sufficient distance to compress the initial volume between the traveling valve and the standing valve at said uppermost position of the traveling valve to a volume in the range of about 1 to 15 percent of said initial volume; and after attaining such compression, allowing said rod to protrude upwardly through said aperture a distance in the range of about 1 to 13 percent of said preset distance in order to contact and displace said closure member from said valve seat as the valve approaches the bottom of the downward stroke of each reciprocal cycle.

6. The improvement of claim 5, including the step of allowing said rod to protrude through said valve seat a maximum distance in the range of at least about 5 cm. and not more than about 13 cm. (2 to 5 in.).

7. The method of claim 5, including the step of allowing said rod to protrude through said aperture a maximum distance in the range of at least about 2 percent and not more than about 4 percent of said preset distance.

8. The method of claim 5, including the step of compressing said initial volume by a ratio in the range of 10:1 to 12:1.

9. In an oil well pump for pumping oil from a well wherein said pump has an elongated cylindrical barrel, a reciprocating piston slideably positioned in the barrel for cyclic reciprocal movement up and down a preset distance in the range of about 1 to 5 meters (3.3 to 16.4 feet) in the barrel for pumping fluid to the surface of the well. a traveling check valve at the bottom of the piston, and a standing check valve at the bottom of the barrel, wherein the traveling check valve has a valve seat with a longitudinally axial aperture therethrough and a moveable closure member above the valve seat, which closure member is adapted for seating in the valve seat for closing the aperture when pressure above the aperture is greater than pressure below the aperture and for moving upwardly from the valve seat to open the aperture when pressure below the aperture is greater than pressure above the aperture, the method of breaking a gas lock between the traveling and standing valves comprising the steps of:

positioning a rigid elongated rod immovably in the barrel above the standing valve in alignment with said aperture in such a manner that reciprocation of said piston and traveling valve upwardly and downwardly in said barrel causes the last portion of each downstroke to lower said traveling valve a distance in the range of at least about 5 cm. and not more than about 13 cm. (2 to 5 in.). with said rod protruding through said aperture, thereby causing said rod to contact said closure member and to displace said closure member away from said valve seat after the space between the standing valve and the traveling valve on each downstroke is compressed from a maximum in each of said up and down cycles to an optimum space before initial displacement of said closure member by a ratio of said maximum space to said optimum space in the range of about 10:1 to 12:1 before displacing the closure member from the valve seat.

10. In an oil well pump for pumping oil from a well wherein said pump has a stationary, elongated, cylindrical barrel, the elongated axis of which defines a longitudinal axis of the barrel and of the pump, a reciprocating piston slideably positioned in said stationary barrel for cyclic reciprocal movement up and down a preset distance in the range of about 1 to 5 meters (3.3 to 16.4 feet) in the barrel for pumping fluid to the surface of the well, a traveling check valve at the bottom of the piston, and a standing check valve at the bottom of the barrel, wherein the traveling check valve has a valve seat with an aperture therethrough with an aperture axis aligned parallel to said longitudinal axis of the pump and a moveable closure member above the valve seat, which closure member is adapted for seating in the valve seat for closing the aperture when pressure above he aperture is greater than pressure below the aperture and for moving upwardly from the valve seat to open the aperture when pressure below the aperture is greater than pressure above the aperture, said traveling valve also having an end wall positioned in said piston a fixed spaced distance above the valve seat to form a cage between said valve seat and said end wall for containing said closure member, and said pump including an elongated, stationary rod positioned in said barrel above said standing valve and in axial alignment with said aperture, the improvement comprising:

said fixed spaced distance between said valve seat and said end wall being in the range of at least about 12 cm. (4.75 in) and said rod being of a sufficient length and positioned in such a manner that it protrudes through said aperture and into said cage a distance in the range of at least about 5 cm. (2 in.) when said piston is at the lower most extremity of said cyclic reciprocal movement.

11. The improvement of claim 10, wherein the distance between said standing valve and said traveling valve when said piston is at the lower most extremity of said cyclic reciprocal movement is in the range of less than about 30 cm. (12 in.), such that the ratio of the space between said standing valve and said traveling valve when said piston is at the upper most extremity of said cyclic reciprocal movement to the space between said standing valve and said traveling valve when said piston is at the point where said rod begins to protrude through said aperture and into said cage is in the range of about 10:1 to 12:1.

* * * * *